US006994011B2

(12) United States Patent
Barfield et al.

(10) Patent No.: US 6,994,011 B2
(45) Date of Patent: Feb. 7, 2006

(54) FIREARM SAFETY DEVICE

(76) Inventors: Christopher A. Barfield, 1111 Willow Brook Dr., Fishers, IN (US) 46038; Joseph A. Kimpel, 11277 Tufton St., Fishers, IN (US) 46038

( * ) Notice: Subject to any disclaimer, the term of this patent is extended or adjusted under 35 U.S.C. 154(b) by 0 days.

(21) Appl. No.: 10/931,501

(22) Filed: Sep. 1, 2004

(65) Prior Publication Data

US 2005/0188581 A1 Sep. 1, 2005

Related U.S. Application Data

(62) Division of application No. 10/457,209, filed on Jun. 9, 2003.

(51) Int. Cl.
*F41A 17/44* (2006.01)

(52) U.S. Cl. ..... 89/29; 42/70.01

(58) Field of Classification Search ..... 42/77, 42/70.01, 70.11; 89/29
See application file for complete search history.

(56) References Cited

U.S. PATENT DOCUMENTS

| | | | | |
|---|---|---|---|---|
| 1,270,436 A | | 6/1918 | Reach | 42/106 |
| 3,418,741 A | | 12/1968 | Tschoepe | 42/77 |
| 3,583,087 A | * | 6/1971 | Huebner | 42/105 |
| 3,657,959 A | * | 4/1972 | Kart | 89/128 |
| 3,708,902 A | | 1/1973 | Foster et al. | 42/1 |
| 4,023,294 A | | 5/1977 | Knopp | 42/1 |
| 4,253,377 A | | 3/1981 | Arnett | 89/163 |
| 4,297,801 A | | 11/1981 | Kahn | 42/59 |
| 4,316,339 A | | 2/1982 | Herriott | 42/59 |
| 4,341,030 A | * | 7/1982 | Little | 42/105 |
| 4,539,889 A | | 9/1985 | Glock | 89/147 |
| 4,586,715 A | | 5/1986 | Scolari et al. | 273/311 |
| 4,648,192 A | | 3/1987 | Harness | 42/77 |
| 4,955,157 A | | 9/1990 | Brighton et al. | 42/77 |
| 5,044,106 A | | 9/1991 | Slocum | 42/70.11 |
| 5,105,569 A | | 4/1992 | Straitiff | 42/2 |
| 5,228,887 A | | 7/1993 | Mayer | 42/75.02 |
| 5,325,617 A | | 7/1994 | Vojta et al. | 42/75.03 |
| 5,410,834 A | | 5/1995 | Benton et al. | 42/75.02 |
| 5,433,134 A | | 7/1995 | Leiter | 89/14.5 |
| 5,519,956 A | | 5/1996 | Howell | 42/70.08 |
| 5,585,589 A | | 12/1996 | Leiter | 89/128 |

(Continued)

OTHER PUBLICATIONS

"The Tactical Edge", National Tacticl Officers Association, Spring 2003, p. 57 and cover page.

(Continued)

*Primary Examiner*—Stephen M. Johnson
(74) *Attorney, Agent, or Firm*—Woodard, Emhardt, Moriarty, McNett & Henry LLP

(57) ABSTRACT

A firearm safety device for installation into an otherwise functional firearm for disabling the firearm with respect to chambering and firing a round of ammunition and thereby enabling the firearm to be used as a training firearm. The functional firearm includes, among other items, a removable barrel that defines the bore for firing a round of ammunition. The barrel replacement is a unitary, solid structure wherein the portion corresponding to the barrel bore is closed, thereby preventing the chambering and firing of any round of ammunition. The barrel replacement is constructed and arranged to accurately and precisely simulate the size and shape of the removable barrel so that once the barrel replacement is installed, all other portions of the firearm remain functional. This enables other aspects of firearm usage and safety to be explained while, at the same time, providing an absolutely safe firearm that is not capable of firing a round of ammunition.

4 Claims, 5 Drawing Sheets

U.S. PATENT DOCUMENTS

| | | | | |
|---|---|---|---|---|
| 5,664,358 | A | 9/1997 | Haber et al. | 42/70.11 |
| 5,666,756 | A | 9/1997 | Moller | 42/77 |
| 5,675,106 | A | 10/1997 | Leiter | 89/14.5 |
| 5,706,599 | A | 1/1998 | Knight | 42/75.02 |
| 5,842,300 | A | 12/1998 | Cheshelski et al. | 42/116 |
| 5,909,000 | A | 6/1999 | Rakov | 89/7 |
| 5,937,563 | A | 8/1999 | Schuetz et al. | 42/106 |
| 6,205,696 | B1 | 3/2001 | Bilgeri | 42/75.02 |
| 6,209,250 | B1 | 4/2001 | Mills | 42/53 |
| 6,295,751 | B1 | 10/2001 | Piwonski | 42/1.15 |
| 6,374,527 | B1 | 4/2002 | Finardi | 42/70.11 |
| 6,442,882 | B1 * | 9/2002 | Dionne | 42/77 |
| 6,493,979 | B2 | 12/2002 | Katzmaier | 42/77 |
| 2001/0045045 | A1 | 11/2001 | Katzmaier | 42/77 |
| 2001/0054247 | A1 | 12/2001 | Stall et al. | 42/106 |
| 2002/0189148 | A1 | 12/2002 | Hanson | 42/70.11 |

OTHER PUBLICATIONS

"Galls" Military and Federal Law Enforcement Edition, 2002, p. 29 and cover page.

Manual of Operation, Glock, 2000, pp. 11-14.

* cited by examiner

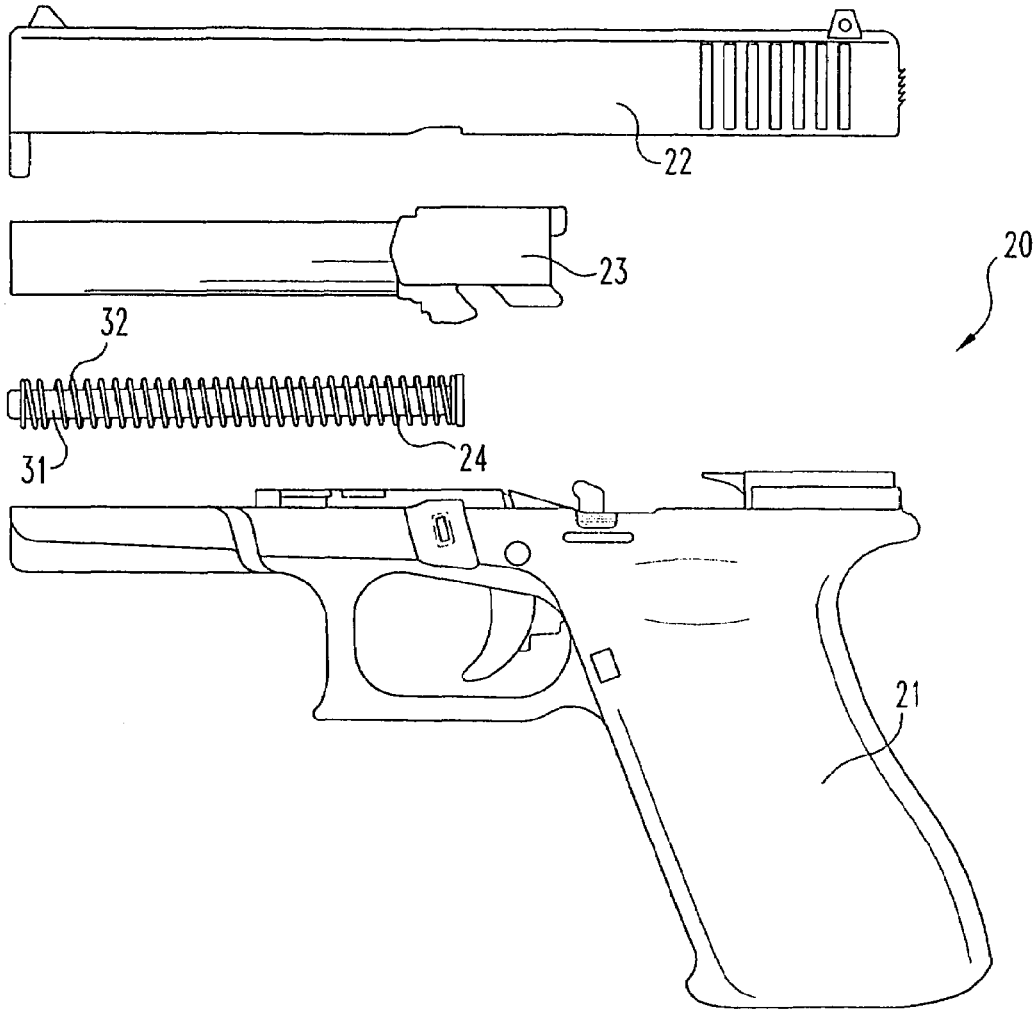
Fig. 2
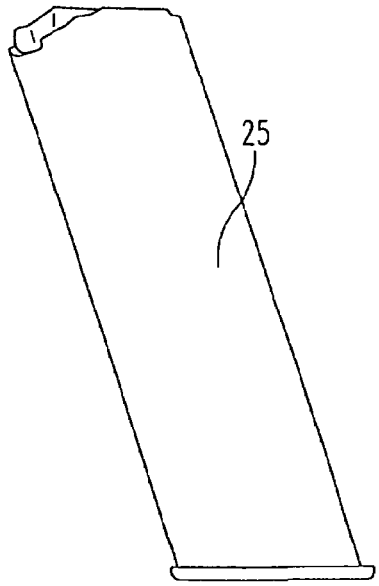

FIREARM SAFETY DEVICE

REFERENCE TO RELATED APPLICATION

The present application is a divisional patent application of U.S. patent application Ser. No. 10/457,209, filed Jun. 9, 2003 entitled "FIREARM SAFETY DEVICE", pending, which is hereby incorporated by reference in its entirety.

BACKGROUND OF THE INVENTION

The present invention relates in general to firearm safety and to devices that are constructed and arranged to cooperate with a firearm in order to provide or enable an added degree of safety. More specifically, the present invention relates to firearm safety devices that are constructed and arranged to actually prevent passage of an ammunition slug through the barrel (i.e., through the bore) of the firearm.

Firearm safety has long been a concern of anyone owning and/or using a firearm, whether for sport or leisure or in connection with a profession, such as law enforcement. There have been concerns regarding the complete removal of ammunition from the firearm, whether by emptying the magazine, removing the magazine, or clearing the chamber. No doubt virtually everyone is aware of firearm accidents where the firearm is discharged and the individual or individuals involved would swear that the firearm was empty. Virtually everyone has been cautioned about firearm safety concerns and, in an effort to protect children, firearm owners have been encouraged to lock up firearms, lock up ammunition, and use safety locks that would be applied directly to the firearm to prevent usage by children or any other unauthorized individual. These recommended measures have met with some degree of success, not only for the safety of children, but for the safety of adults as well. Nevertheless, accidents still happen, even with these types of safeguards.

It is likely that the level of risk of an accident occurring with a firearm is related to the frequency of use of the firearm and the nature of use. Statistically, with more limited use, there are fewer opportunities for someone to forget to remove the ammunition and fewer opportunities to forget to lock or lock up the firearm. When small children are not present, there is likely a lower risk of careless use or use of the firearm without proper supervision. With frequent use of a firearm and whenever several individuals are involved in the use or at least present during use, the risks increase. Someone may simply forget to properly empty the firearm and/or properly secure it. One of the individuals using the firearm or present during use may assume that someone else is taking the responsibility for firearm safety and the unfortunate reality may be that no one assumes this responsibility.

One activity where firearm safety is extremely important is during firearm training. In the context of the present invention, this firearm training is by and for law enforcement personnel. One of the needs, as part of firearm safety and firearm training, is to have a firearm that can be used for demonstration and training. If the selected firearm is otherwise fully functional, it is critical for safety concerns to first clear the chamber and empty or remove the magazine. Even when care is taken in this regard, accidents still happen. Additionally, those being trained are apprehensive when a fully functional firearm is used as the training weapon. To combat these concerns and reduce the level of anxiety, a number of techniques and approaches have been tried. For example, a broken or damaged pistol can be used for training, a pistol with parts removed can be used, a special training pistol can be created, or at times even a one-piece molded pistol is used. With some of these options, color coding is used to help alert others that the particular firearm or pistol is in fact a training or teaching pistol.

There are though disadvantages with each of the options listed above. With a broken or damaged pistol, or with a pistol where parts are removed (and not replaced), it is likely that the actual firearm will not have all of the component parts that are required to conduct all of the required training. This problem is particularly true for the one-piece, molded training pistol. For example, if the magazine is removed or if the magazine is only simulated by the one-piece molded construction, then one important training aspect cannot be demonstrated. When one arm or hand of a law enforcement officer is incapacitated, that officer needs to be able to remove the empty magazine from the firearm and insert a full magazine. While there are specific training techniques that demonstrate how this can be done, such training is not possible if there is not a fully functioning magazine and receiver as part of the firearm.

The pistols that are specifically manufactured for training purposes with one or more safety modifications to make the pistols nonfunctional are expensive and may still not possess all of the functional capabilities that would enable all actions and uses to be demonstrated as part of any training program.

The present invention provides a unique solution to the problem. The present invention includes a molded plastic barrel replacement component for the corresponding pistol. The barrel replacement component is a one-piece construction with the bore portion completely closed. Otherwise, this molded plastic barrel replacement is identical to the actual pistol barrel. The present invention allows an actual pistol or other firearm to be easily converted to a training weapon and then back again to a fully functional weapon with absolute and complete safety. By color coding the plastic barrel replacement, such as red or yellow, any observer will know at once that the pistol has been converted and there should not be any anxiety. The functional weapon is selected, the existing barrel removed, and the plastic barrel replacement assembled, thereby completing the conversion and converting the otherwise functional weapon to a training weapon. As should be clear, the pistol remains fully functional for all other training aspects, except that it is impossible to load any ammunition into the chamber due to the solid, one-piece construction of the plastic (substitute) barrel replacement.

The present invention is directed to replacement of a component part in the firearm. All other prior art devices either mold the entire firearm (nonfunctional) or remove a critical portion, without any replacement, or add something such as a rod or bar inserted into the barrel. In the first two situations, the firearm is not functional and important facets of the overall training agenda may not be demonstratable. In the last example, the added component can be removed, whether inadvertently or otherwise, and the firearm could fire. If the firearm is able to discharge even with a rod inserted in the barrel, then injury could result.

SUMMARY OF THE INVENTION

A firearm safety device for installation into an otherwise functional firearm for disabling the firearm, the firearm including a removable barrel, according to one embodiment of the present invention comprises a barrel replacement constructed and arranged to simulate the size and shape of the removable barrel, the barrel replacement being constructed and arranged to prevent the chambering of any round of ammunition in the barrel replacement.

One object of the present invention is to provide an improved firearm safety device.

Related objects and advantages of the present invention will be apparent from the following description.

BRIEF DESCRIPTION OF THE DRAWINGS

FIG. 2 is an exploded view of the FIG. 1 firearm showing the primary component parts as disassembled.

DESCRIPTION OF THE PREFERRED EMBODIMENTS

Figure 1:
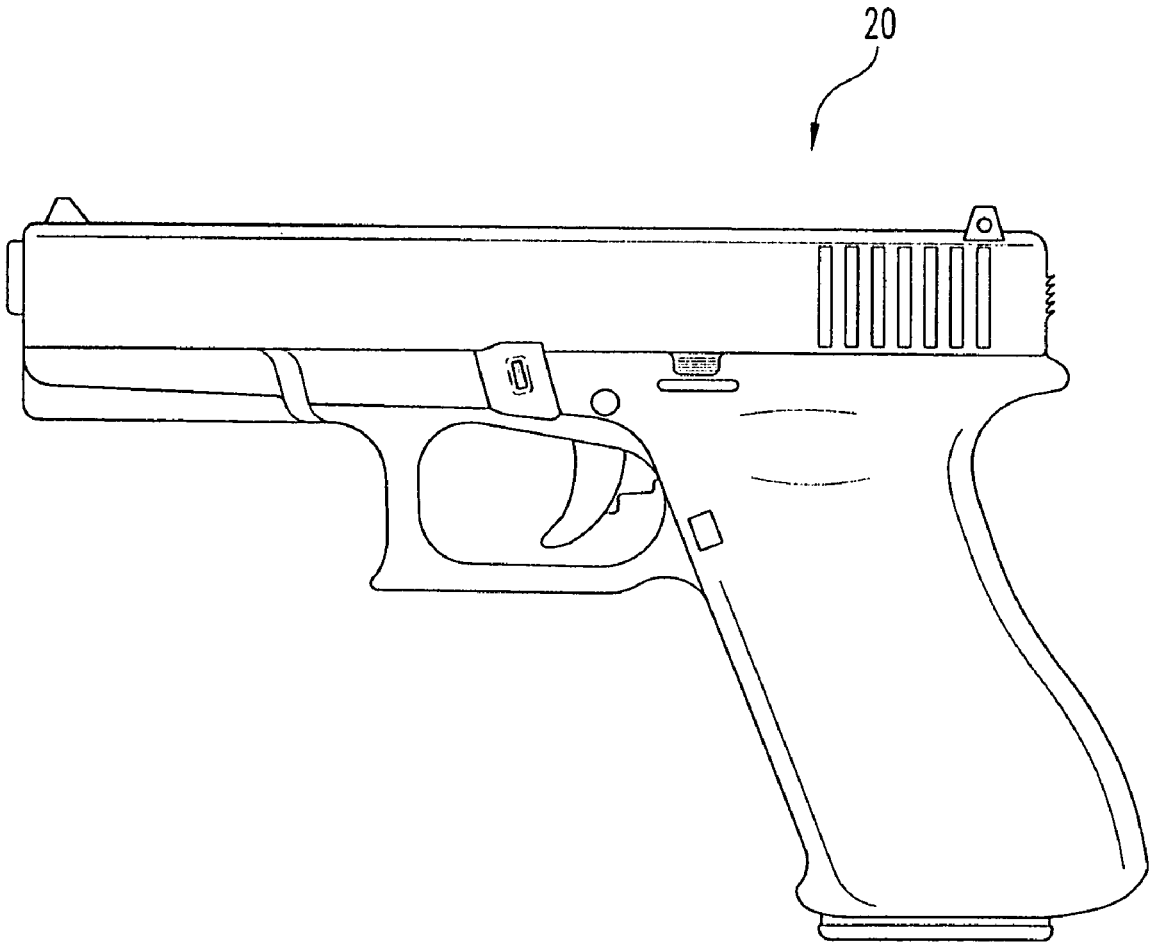
FIG. 1 is a side elevational view of a firearm that will be used to help explain the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated an automatic pistol 20 that represents a fully functional firearm for the purpose of explaining the structure and use of the present invention. While the present invention is suitable for use with a variety of firearms, a GLOCK® automatic pistol has been selected for describing the preferred embodiment of the present invention, due in part to the name recognition of this firearm and due in part to the popularity of this firearm with law enforcement personnel.

Figure 7:
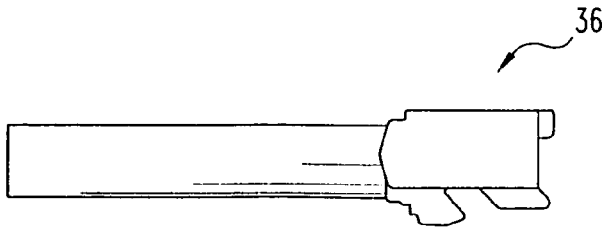
FIG. 7 is a side elevational view of a barrel replacement to be inserted into the FIG. 1 firearm to replace the barrel that is removed.

Referring to FIG. 2, an exploded view of pistol 20 is illustrated, showing the primary component parts or subassemblies that can be disassembled. Pistol 20 includes a frame or receiver 21, slide 22, barrel 23, recoil spring assembly 24, and magazine 25. Anyone familiar with this brand and type of pistol would likely be familiar with these primary component parts as well as their structural and functional relationships. As will be described herein, the focus of the present invention is directed to the removal of the fully functional barrel 23 from pistol 20 and the step of replacing barrel 23 with a unitary, "dummy" barrel that does not permit a round of ammunition to be fired therethrough. In the limited sense of the pistol being unable to fire a round of ammunition with the dummy barrel installed, the dummy barrel converts pistol 20 to a "nonfunctioning" status. However, this descriptive term is not used relative to the entire pistol because all other aspects of pistol 20 are intended to remain fully functional. For example, such as being able to remove the magazine from the receiver and reinsert the magazine or insert a new magazine into the receiver and being able to operate the slide and/or trigger mechanism. The present invention as illustrated in FIG. 7 is described herein as a barrel replacement. The solid, one-piece construction does not enable any round of ammunition to be chambered.

In order to be able to remove barrel 23 for replacement with the present invention replacement barrel, certain preliminary steps need to be taken, some for safety and some to be able to have access to barrel 23 within pistol 20. Since the present invention is directed to a firearm safety device, a few precautionary steps are recommended whenever handling any firearm, including pistol 20, for the ultimate removal of barrel 23. First, it is advisable to remove the magazine and thereafter verify that the pistol is unloaded. These procedures are well known to those familiar with a GLOCK® pistol of the type illustrated in FIGS. 1 and 2. While the steps are being performed, the pistol should be pointed in a safe direction away from any individuals.

Figure 3:
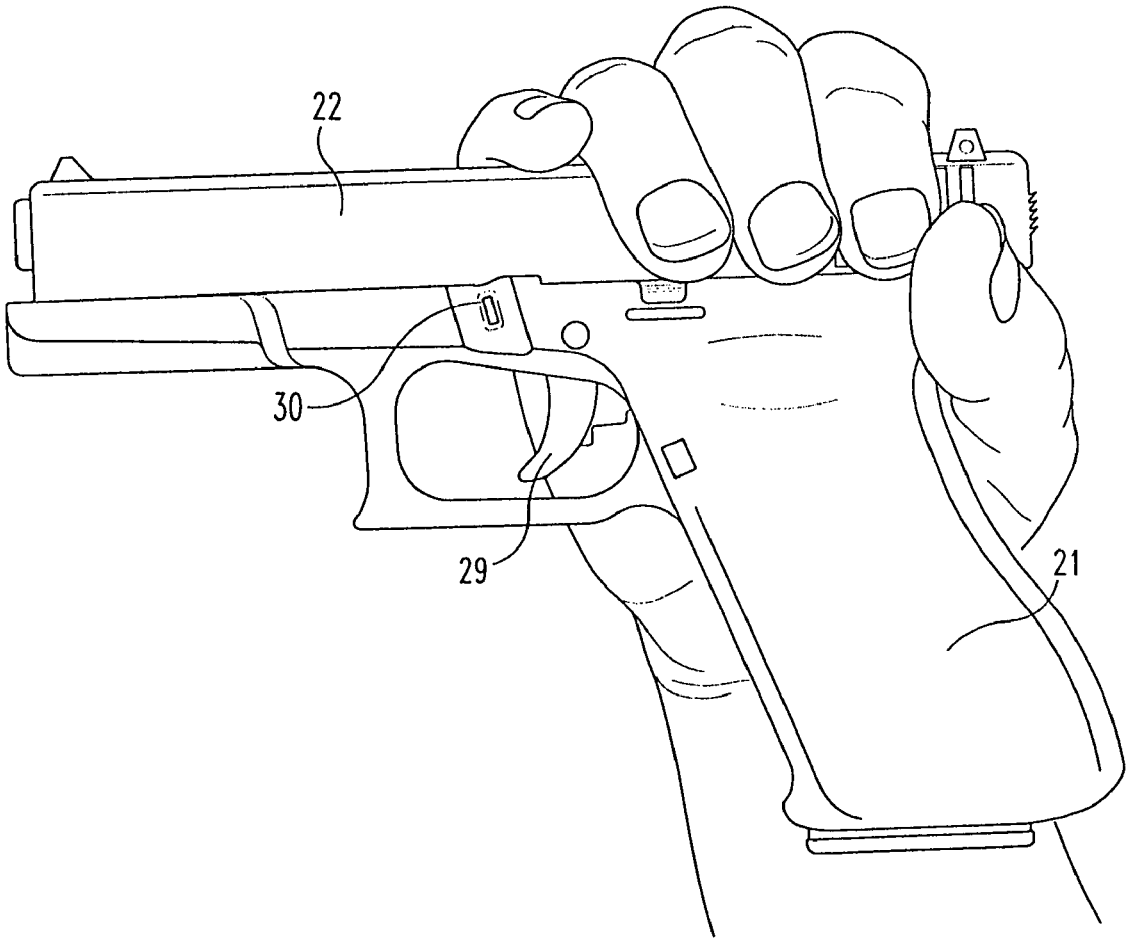
FIG. 3 is a side elevational view of the FIG. 1 firearm illustrating one step in removal of a slide portion of the firearm.

The first "structural" step is slide 22 removal. The position of the hand is illustrated in FIG. 3. Holding the pistol 20, as illustrated in FIG. 3, pull and hold the slide 22 back approximately 0.10 inches (2.5 mm). The trigger 29 has to be in the rear position to be able to disassemble the slide 22 from receiver 21.

Figure 4:
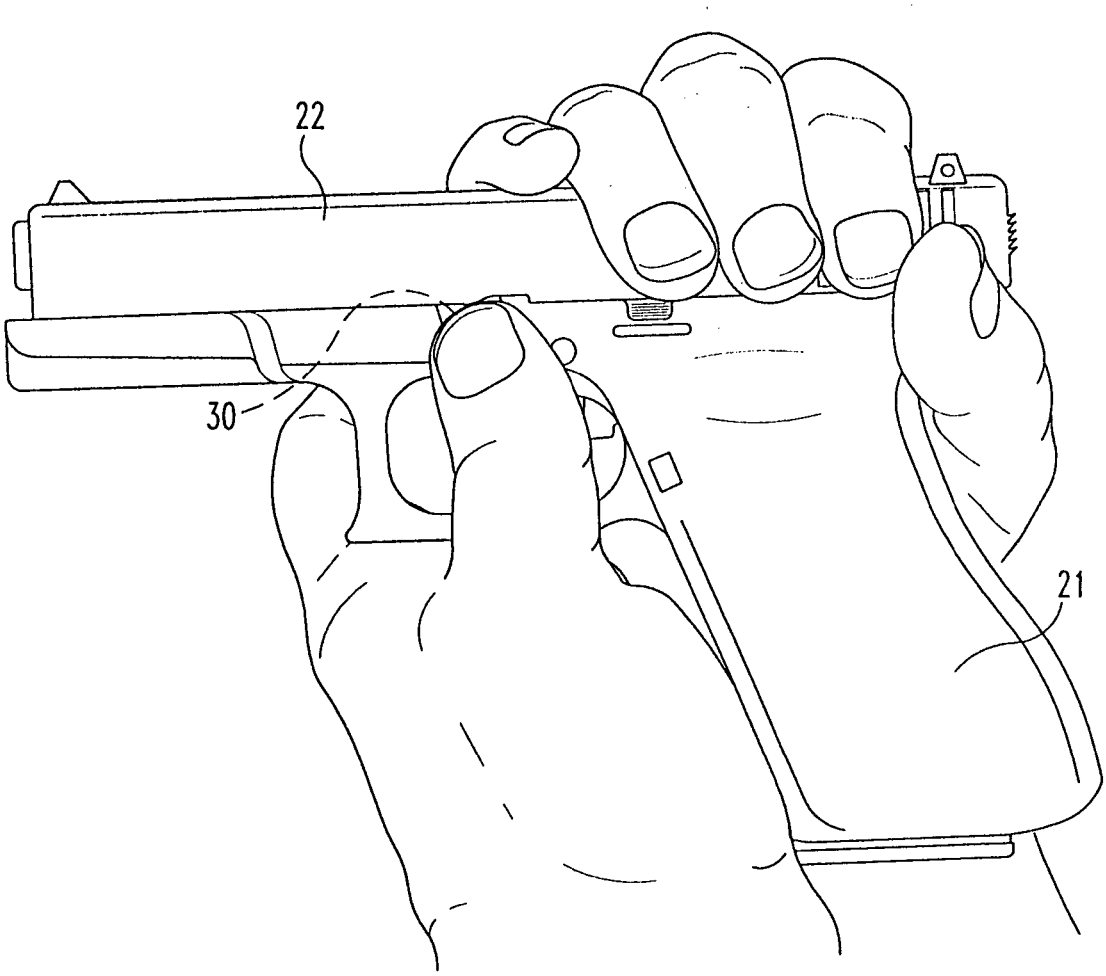
FIG. 4 is a side elevational view of the FIG. 1 firearm illustrating a subsequent step in slide removal.

The next step (see FIG. 4) is to simultaneously pull down the slide lock 30 and hold both sides,of it using the thumb and index finger of the other hand. The concluding step for slide removal is to push the slide 22 forward until it is fully separated from the receiver 21.

Figure 5:
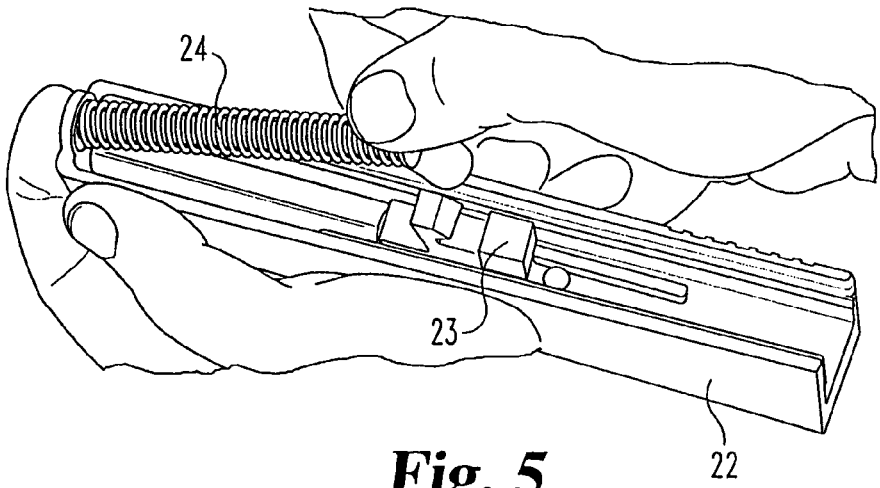
FIG. 5 is a top perspective view of the FIG. 1 firearm with the slide removed, illustrating one step in the removal of a recoil spring assembly.

Removal of slide 22 exposes the recoil spring assembly 24 and therebeneath the removable barrel 23. In order to remove barrel 23, the first step is to remove the recoil spring assembly 24 from the slide 22. The recoil spring assembly 24 includes a recoil spring guide or tube 31 and a surrounding coil spring 32. Step one in this process is to push the recoil spring tube 31 slightly forward while lifting the recoil spring assembly 24 upwardly away from barrel 23 (see FIG. 5).

Figure 6:
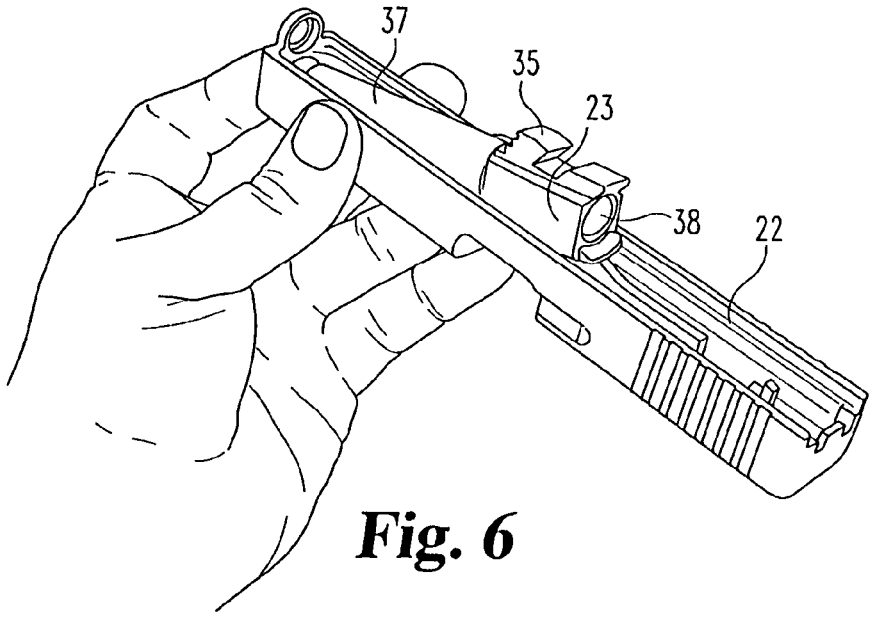
FIG. 6 is a top perspective view of the FIG. 1 firearm illustrating removal of a barrel from the FIG. 1 firearm.

With the recoil spring assembly 24 removed, the barrel 23 is exposed as it lays in the slide 22. Referring now to FIG. 6, in order to remove barrel 23, first grasp the barrel lug 35 and, while raising the chamber end, move the barrel 23 slightly forward. The concluding step is to lift barrel 23 from the slide 22. In order to install the present invention replacement barrel 36 (see FIG. 7) into slide 22, or to reinstall the fully functioning barrel 23, the foregoing steps for barrel removal are simply followed in the reverse order.

Barrel 23 includes the lug portion 35 and the barrel end portion 37. Extending through the entire length of barrel 23 is bore 38. In the replacement barrel 36 of the present invention, as illustrated in FIG. 7, there is no bore extending through the entire length of barrel replacement 36 due to the solid, unitary construction. This in turn prevents the "converted" pistol from being able to receive a round of ammunition in the barrel. The "dummy" barrel replacement 36 is constructed and arranged to be identical in all respects to barrel 23, except that the bore 38 is closed and except for the selected material to be used for barrel replacement 36.

Preferably, barrel replacement 36 is a unitary molded (or cast) structure that has an exterior size and shape that is substantially identical to barrel 23 in all respects. Whether the barrel replacement 36 is hollow or solid, the important structural point to note is that there is no bore and thus no opening to receive (chambering) or pass a round of ammunition. The material options for barrel replacement 36 include plastics and synthetic resins as well as metals and metal alloys. It is contemplated that whatever material is selected for the unitary molding or casting, it will have a contrasting appearance relative to the remainder of the pistol. The contrasting appearance is preferably color based by adding pigment to the molding of any plastic or synthetic resin and by a post-casting surface treatment, such as anodizing for metals and metal alloys.

The contrasting appearance for barrel replacement 36 according to the present invention provides an immediate and positive confirmation to the user of the pistol as well as those nearby that the pistol 20 has been converted for safety concerns and cannot discharge a round of ammunition. Being able to recognize that a "dummy" barrel replacement 36 has been installed into pistol 20 in order to convert it to a non-firing training firearm will reduce, if not eliminate, any anxiety that might otherwise be present when one has simply been told that the firearm is safe. The obvious problem with being told that the firearm is safe is that there is no way to independently verify that fact except by personal inspection.

It should be understood that barrel replacement 36, while unitary and preferably solid, can have voids and openings in nonfunctional or noncritical areas so as to not interfere with the otherwise normal operation of pistol 20 and its various component parts. Since barrel replacement 36 is preferably molded, if made out of plastic or a synthetic resin, and cast if metal, the only perceived "needs" to provide voids or openings as part of barrel replacement 36 might be to reduce weight and/or use less material. However, in order to provide the most realistic simulation of barrel 23 by barrel replacement 36, their respective weights should be substantially the same. For a plastic material, this could require some type of filler in order to increase the weight of barrel replacement 36. Importantly, the chamber portion of the barrel replacement is closed or partially closed or reduce in inside diameter (i.e. by solid molded plastic or cast metal) so that a round cannot be chambered.

While the prior art includes the use of one-piece molded firearms in plastic, typically colored in blue or red, as training aids, there is a limited amount of training that can actually be done using these types of simulated firearms because there is nothing functional as part of this artificial firearm. In contrast, the present invention retains every component part of the otherwise fully functional pistol, with the only exchange or replacement being the barrel. With regard to training, much more can be taught with the modified pistol of the present invention as compared to the referenced red plastic training aid. For example, when law enforcement officer has one arm or hand that is injured or in some way disabled, the normal procedures for changing the magazine cannot be performed. Law enforcement officers need to be trained with alternate techniques, such as using the one "good" hand and another aid, such as a belt edge or buckle. The blue (or red) plastic training aid is obviously unacceptable for this type of training since there is no functioning magazine and no functioning receiver. There is also no functioning slide and no functioning trigger.

Preferably, barrel replacement 36 is identical to barrel 23 in all aspects relative to the exterior size and shape. This then permits all other portions of pistol 20 to function in their normal manner. For example, the recoil spring assembly 24 can be used with barrel replacement 36 as well as the slide 22 and the slide action. The use and loading or unloading action of the magazine has already been described and remains fully functional, even with barrel replacement 36 installed. Since the portion of barrel replacement 36 that corresponds to bore 38 of barrel 23 is closed by the molded or cast material of barrel replacement 36, it is not possible for a round of ammunition to be fired. With the entire length of the bore portion closed with molded or cast material as part of the unitary structure of barrel replacement 36, no round of ammunition can be placed into barrel replacement 36. Even with only part of the bore portion closed, it is still not possible to fire a round.

Other prior art firearm safety devices have similar negative issues to what has already been mentioned for the molded, red plastic training aid. Most of these similar negative issues are due to the manner in which these other safety devices interfit into the firearm or structurally add something that alters the exterior size and shape of the firearm. If a safety item is added without otherwise changing the firearm, removal of that safety item returns the firearm to its functional status and this is a concern. With the present invention, securing the original barrel prevents tampering. The present invention provides a complete and identical barrel replacement so that virtually every other aspect or facet of the firearm remains fully functional, except that rounds of ammunition cannot be loaded into the barrel replacement 36 and nothing can be fired from the modified pistol. The size and shape of the modified or converted pistol, in other words pistol 20 with barrel replacement 36, remains the same. The result is a totally and absolutely safe pistol that can be used for all phases and aspects of training and can be visually identified as a "safe" pistol that is not capable of firing rounds of ammunition. With the original barrel 23 safely secured, even if barrel replacement 36 is removed, whether inadvertently or deliberately, the firearm is not functional.

While the present invention has been described in the context of a GLOCK® brand pistol, the present invention is suitable for any firearm that includes a barrel that can be removed by the user. In this way, the present invention enables the conversion of a fully functional firearm into a training firearm that is totally safe and that can be used for virtually all aspects of explaining firearm safety and firearm training. The method of converting the pistol enabled by the present invention also permits the training firearm to be converted back to a fully functional firearm by removing the barrel replacement 36 and reinstalling the original barrel 23.

The present invention includes the design, construction, and use of a firearm safety device in the form of a unitary firearm barrel replacement that is not capable of receiving a round of ammunition (chambering) and that replaces the functioning barrel 23. This barrel replacement 36 converts a fully functioning firearm into a training firearm that can be restored to its fully functioning condition by simply removing barrel replacement 36 and reinstalling the original barrel 23. The present invention allows any law enforcement officer to take his issued firearm and convert it into a training firearm at any time with a minimum number of steps, noting that the resultant training firearm is totally safe and, except for the barrel replacement, is fully functional. Whenever the training use is concluded, barrel replacement 36 is removed and the original barrel 23 is reinstalled, also with a minimum number of steps, thereby restoring the firearm to its fully functional condition.

Another facet of the present invention is the method of converting a fully functioning firearm into a training firearm by the addition of the present invention safety device. Related to this facet of the present invention is the method of converting a training firearm to a fully functioning firearm by removal of the present invention safety device and reinstalling the original barrel.

Yet another facet of the present invention is the design and construction of a training firearm that can be converted into a fully functional firearm.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of converting a functional firearm having a slide, barrel, and recoil spring assembly into a training firearm comprises the following steps:

(a) providing a unitary barrel replacement that simulates the size and shape of the functional firearm barrel and is constructed and arranged for preventing the chambering of any round of ammunition;

(b) removing the slide of the functional firearm;

(c) removing the recoil spring assembly of the functional firearm;

(d) removing the barrel of the functional firearm;

(e) installing a single component as the entire replacement for the removed barrel, said single component being said unitary barrel replacement;

(f) installing the recoil spring assembly; and (g) installing the slide.

2. A method of restoring a training firearm into a functional firearm, said training firearm having a slide, a unitary barrel replacement, and a recoil spring assembly, the unitary barrel replacement being constructed and arranged to prevent the receipt of any foreign object within said unitary barrel replacement and to simulate the size and shape of a functional firearm barrel, said method comprising the following steps:

(a) providing a functional firearm barrel;

(b) removing the slide of the training firearm;

(c) removing the recoil spring assembly of the training firearm;

(d) removing a single component as the entirety of what must be removed for installing a functional firearm barrel, said single component being said unitary barrel replacement of the training firearm;

(e) installing said functional firearm barrel;

(f) installing the recoil spring assembly; and (g) installing the slide.

3. A method of convening a functional firearm having a removable barrel into a training firearm comprises the following steps:

(a) providing a unitary barrel replacement that simulates the size and shape of the removable barrel and is constructed and arranged for preventing the chambering of any round of ammunition;

(b) removing the removable barrel of the functional firearm; and (c) installing a single component as the entire replacement for the removed barrel, said single component being said unitary barrel replacement.

4. A method of restoring a training firearm into a functional firearm, said training firearm having a unitary barrel replacement, the unitary barrel replacement being constructed and arranged to prevent the receipt of any foreign object within said unitary barrel replacement and to simulate the size and shape of a functional firearm barrel, said method comprising the following steps:

(a) providing a functional firearm barrel;

(b) removing a single component as the entirety of what must be removed for installing a functional firearm barrel, said single component being said unitary barrel replacement of the training firearm; and (c) installing said functional firearm barrel.

* * * * *